US008928544B2

(12) United States Patent
Massie et al.

(10) Patent No.: US 8,928,544 B2
(45) Date of Patent: Jan. 6, 2015

(54) WIDEBAND CIRCULARLY POLARIZED HYBRID DIELECTRIC RESONATOR ANTENNA

(75) Inventors: Gabriel Massie, Brownsburg-Chatham (CA); Mathieu Caillet, Kingston (CA); Michel Clenet, Gatineau (CA); Yahia M. M. Antar, Kingston (CA)

(73) Assignee: Her Majesty the Queen in Right of Canada as Represented by the Minister of National Defence, Ottawa, Ontario (CA)

( * ) Notice: Subject to any disclaimer, the term of this patent is extended or adjusted under 35 U.S.C. 154(b) by 480 days.

(21) Appl. No.: 13/031,304

(22) Filed: Feb. 21, 2011

(65) Prior Publication Data

US 2012/0212386 A1 Aug. 23, 2012

(51) Int. Cl.

| | |
|---|---|
| ***H01Q 13/12*** | (2006.01) |
| ***H01Q 9/04*** | (2006.01) |
| ***H01Q 1/50*** | (2006.01) |
| ***H01Q 13/10*** | (2006.01) |
| ***H01Q 1/24*** | (2006.01) |

(52) U.S. Cl.

CPC ..... *H01Q 1/243* (2013.01); *H01Q 9/0492* (2013.01)

USPC ..... 343/769; 343/850; 343/767; 343/770

(58) Field of Classification Search

CPC ..... H01Q 13/106

USPC ..... 343/850, 769

See application file for complete search history.

(56) References Cited

U.S. PATENT DOCUMENTS

| | | | | |
|---|---|---|---|---|
| 5,453,754 | A * | 9/1995 | Fray | 343/789 |
| 5,940,036 | A * | 8/1999 | Oliver et al. | 343/700 MS |
| 6,452,560 | B2 * | 9/2002 | Kunysz | 343/770 |
| 8,179,323 | B2 * | 5/2012 | Shamblin et al. | 343/700 MS |
| 2008/0074337 | A1 * | 3/2008 | Manholm et al. | 343/769 |

OTHER PUBLICATIONS

Huang et al. "Cross-Slot-Coupled Microstrip Antenna and Dielectric Resonator Antenna for Circular Polarization" IEEE Trans. Antennas Propag. vol. 47, No. 4, pp. 205-609, Apr. 1999.*

Pozar et al. "A Dual-Band Circularly Polarized Aperture-Coupled Staked Microstrip," IEEE Trans. in Antennas and Propag. vol. 45, No. 11, pp. 1618-1625, Nov. 1997.*

Buerkle et al. ("Compact Slot and Dielectric Resonator Antenna with Dual—Resonance, Broadband Characteristics", IEEE Trans. on Antennas and Propag. vol. 53, No. 3, Mar. 2005.*

Fang et al. "Compact Differential Rectangular Dielectric Resonator Antenna" IEEE Antennas and Wireless Propag. Letters, vol. 9, pp. 662-665, Jul. 2010).*

(Continued)

*Primary Examiner* — Dameon E Levi
*Assistant Examiner* — Ricardo Magallanes
(74) *Attorney, Agent, or Firm* — Brion Raffoul

(57) ABSTRACT

The present invention provides a dielectric resonator antenna comprising: a dielectric resonator; a ground plane, operatively coupled with the dielectric resonator, the ground plane having four slots; and a substrate, operatively coupled to the ground plane, having a feeding network consisting of four microstrip lines; wherein the four slots are constructed and geometrically arranged to ensure proper circular polarization and coupling to the dielectric resonator; and wherein the antenna feeding network combines the four microstrip lines with a 90 degree phase difference to generate circular polarization over a wide frequency band.

15 Claims, 15 Drawing Sheets

(56) References Cited

OTHER PUBLICATIONS

Caillet et al. "A Broadband Folded Printed Quadrifilar Helical Antenna Employing a Novel Compact Planar Feeding Circuit" IEEE Trans. on Antennas and Propag. vol. 58, No. 7, pp. 2203-2209, Jul. 2010.*

Huang et al. "Frequency-adjustable circularly polarized dielectric resonator antenna with slotted ground plane" IEEE Elect. Letters, vol. 39, No. 14, Jul. 2003.*

Chen et al. "A Compact Dual-band Dielectric Resonator Antenna using a Parasitic Slot" IEEE Antennas and Wireless Propagation Letters, vol. 8, pp. 173-176, Apr. 2009.*

Petosa et al. ("Dielectric Resonator Antennas: A Ahistorical Review and the Current State of the Art" IEEE Antennas and Prop. Magazine vol. 52, Issue 5, p. 91-116; Oct. 2010).*

Khoo et al. ("Wideband Circularly Polarized Dielectric Resonator Antenna" IEEE Trans. on Antennas and Propag. vol. 55, No. 7, Jul. 2007. pp. 1929-1932).*

K. W. Leung et al., "Circular-polarised dielectric resonator antenna excited by dual conformal strips", Electronics Letters, vol. 36, No. 6, pp. 484-486, Mar. 2000.

A. Buerkle et al., "Compact Slot and Dielectric Resonator Antenna With Dual-Resonance, Broadband Characteristics", IEEE Transactions on Antennas and Propagation, vol. 53, No. 3, pp. 1020-1027, Mar. 2005.

M. Caillet et al., "A Compact Wide-Band Rat-Race Hybrid Using Microstrip Lines", IEEE Microwave and Wireless Components Letters, vol. 19, No. 4, pp. 191-193, Apr. 2009.

* cited by examiner

WIDEBAND CIRCULARLY POLARIZED HYBRID DIELECTRIC RESONATOR ANTENNA

FIELD OF THE INVENTION

The present invention relates to wideband circularly polarized antennas.

BACKGROUND OF THE INVENTION

Most satellite communication and navigation systems transmit signals using circularly polarized (CP) waves to benefit from the advantages that CP waves offer. Circularly polarized antennas having good axial ratio (AR) over the operating frequency band and over a wide half-power beamwidth (HPBW) are then required to establish and maintain satellite links from any location on Earth. In particular, the navigation applications using any satellite navigation systems (SNS) need antennas exhibiting an excellent AR over a wide frequency band (or multiple bands) and over a wide beamwidth to overcome low horizon signal reception.

Some of the prior art antennas that meet some of these requirements are: (1) the printed stacked patch antenna, (2) the cross printed dipole, and (3) the Folded Printed Quadrifilar Helical Antenna (FPQHA).

Dielectric Resonator Antennas (DRAs) offer high-radiation efficiency, a high degree of flexibility, and have inherently a wide operating bandwidth. In addition, compact antennas based on dielectric resonators are achievable by optimizing the width to height ratio or using high permittivity material. However, in the prior art, little attention has been given to multi-band and wideband circularly polarized DRA designs.

A more recent approach to improve the bandwidth of DRA antennas consists of combining two radiating bands, one using the dielectric resonator and one using the feed network. In this case, the feed network is performing a dual function: providing feeding to the DRA and also radiating on its own, but at a predefined band. Such an antenna is referred to as a hybrid dielectric resonator antenna. This type of antenna can have a very wide bandwidth while maintaining its radiation characteristics over the operating frequency band.

Several techniques have been proposed to generate CP when using DRAs. The different techniques can be classified into two categories: (1) single probe feed, and (2) multiple probe feed. Single probe feed schemes generally do not achieve AR bandwidth as wide as multiple probe feed. Their frequency bandwidth is usually limited to a few percent. By contrast, multiple probe configurations allow broad AR bandwidth, in the range of 20%.

In the prior art, Leung et al. disclose that DRA designs fed by conformal lines are interesting solutions to generate CP over a wide bandwidth [K. W. Leung, W. C. Wong, K. M. Luk, and E. K. N. Yung, "Circular-polarised dielectric resonator antenna excited by dual conformal strips," Electron. Lett., vol. 36, no. 6, pp. 484-486, March 2000]. However, the bandwidth obtained here is not sufficient to cover the 32.2% bandwidth including all the SNS, from 1.16 to 1.61 GHz. Buerkle et al. also presented a dual-band DRA achieving a bandwidth over 25% [A. Buerkle, K. Sarabandi, H. Mosallaei, "Compact Slot and Dielectric Resonator Antenna With Dual-Resonance, Broadband Characteristics," IEEE Trans. Antennas and Propag., vol. 53, no. 3, pp. 1020-1027, March 2005].

Based on the aforementioned shortcomings of the prior art, the present invention seeks to provide an improved hybrid DRA design.

SUMMARY OF INVENTION

The present invention provides a hybrid antenna comprised of a DRA and four sequentially rotated feed slots to enhance the AR bandwidth in order to cover the entire SNS frequency bandwidth with one antenna.

The hybrid DRA design of the present invention offers a greater bandwidth and a better axial ratio compared to other CP DRA presented in the prior art. Among the advantages of this antenna are its compact geometry and its relatively low profile.

In one aspect, the present invention provides a dielectric resonator antenna comprising: a dielectric resonator; a ground plane, operatively coupled with the dielectric resonator, the ground plane having four independent slots with each slot being arc in shape and forming a ring configuration; and a substrate, operatively coupled to the ground plane, having a feeding network consisting of four microstrip lines, with each microstrip line feeding independently into each slot, wherein the four slots are constructed and geometrically arranged to ensure proper circular polarization and coupling to the dielectric resonator; and wherein the antenna feeding network combines the four microstrip lines with a 90degree phase difference to generate circular polarization over a wide frequency band.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION OF THE INVENTION

Figure 1:
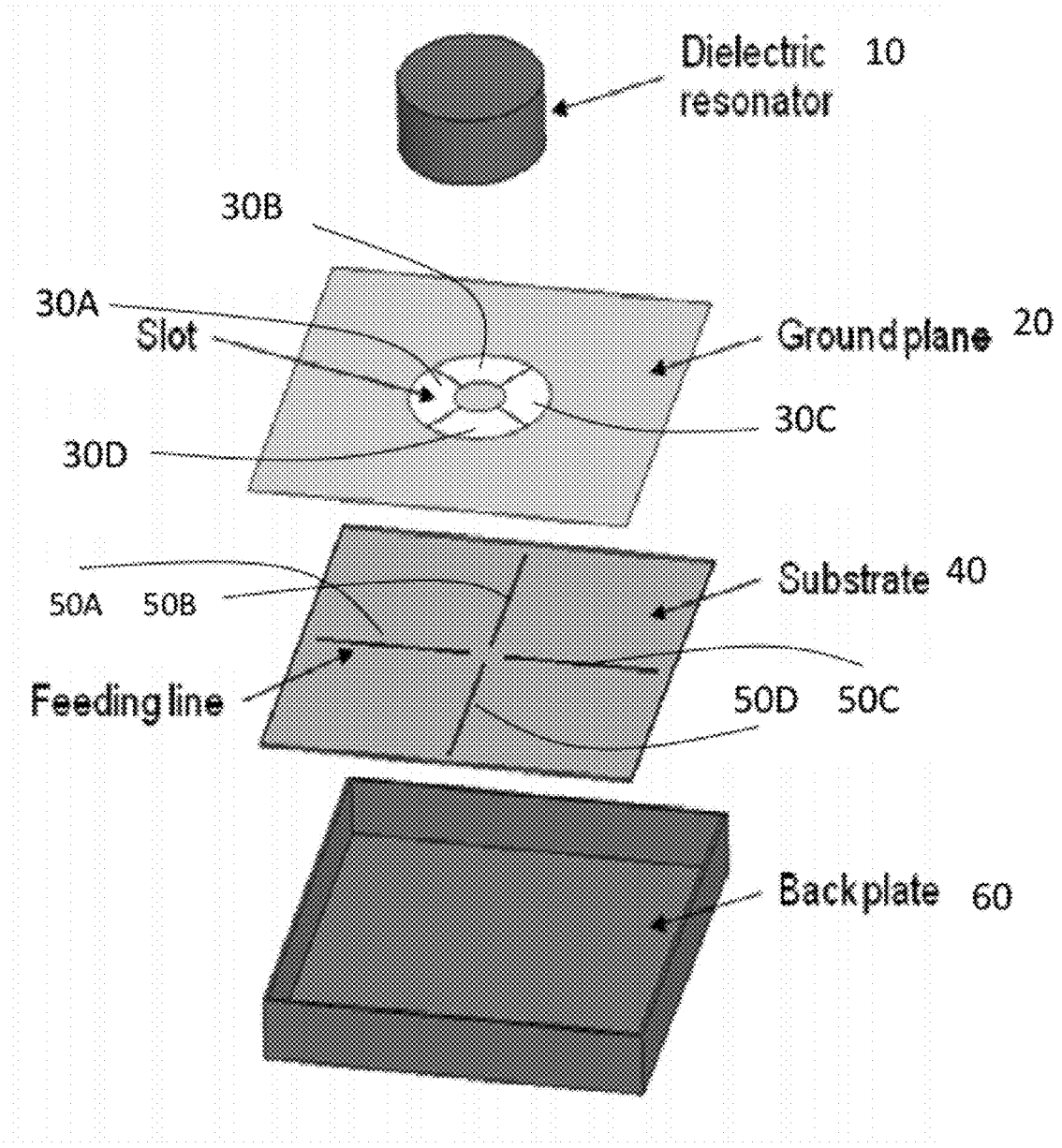
FIG. 1 shows an exploded view of a hybrid DRA in accordance with an embodiment of the present invention.

The present invention includes a cylindrical DRA fed by four slots that are constructed and geometrically arranged to ensure proper circular polarization and coupling to the dielectric resonator. FIG. 1 shows an exploded view of the hybrid DRA configuration according to an embodiment of the present invention.

As shown in FIG. 1, the hybrid DRA consists of a dielectric resonator 10, a ground plane 20 that includes four (4) slots 30A, 30B, 30C, 30D, a substrate 40 that includes four (4) feeding lines 50A, 50B, 50C, 50D, and a black plate housing 60. The dielectric resonator 10 is operatively coupled to the ground plane 20. The ground plane 20 is in turn operatively coupled to the substrate 40. Finally, the substrate 40 may be operatively coupled to a back plate housing 60 in accordance with an alternative embodiment of the present invention.

Figure 2:
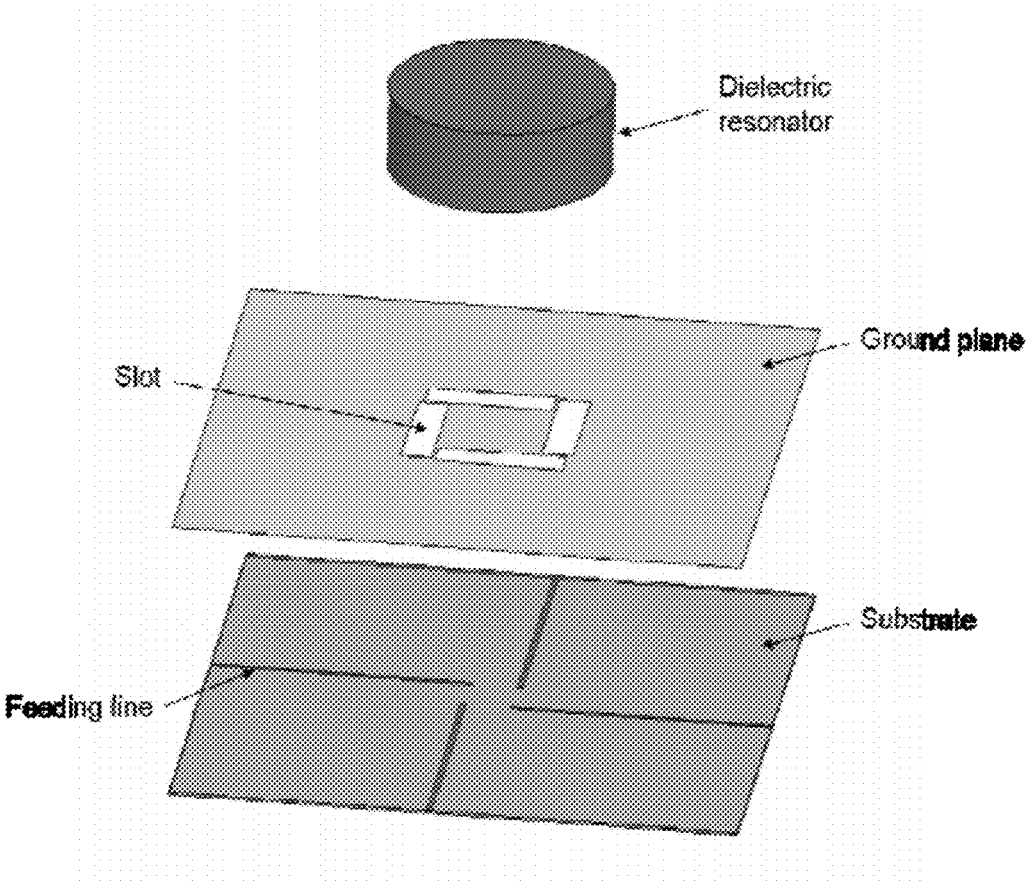
FIG. 2 shows an exploded view of a hybrid DRA in accordance with another embodiment of the present invention.

In FIG. 1, the four (4) slots 30A, 30B, 30C, 30D are arc-shaped. However, the present invention contemplates other shapes, such as rectangular. FIG. 2 is an exploded view of a hybrid DRA in accordance with another embodiment of the present invention, in which the four slots are rectangular in shape. Therefore, the present invention is not limited to a specific shape for each of the slots.

Figure 3:
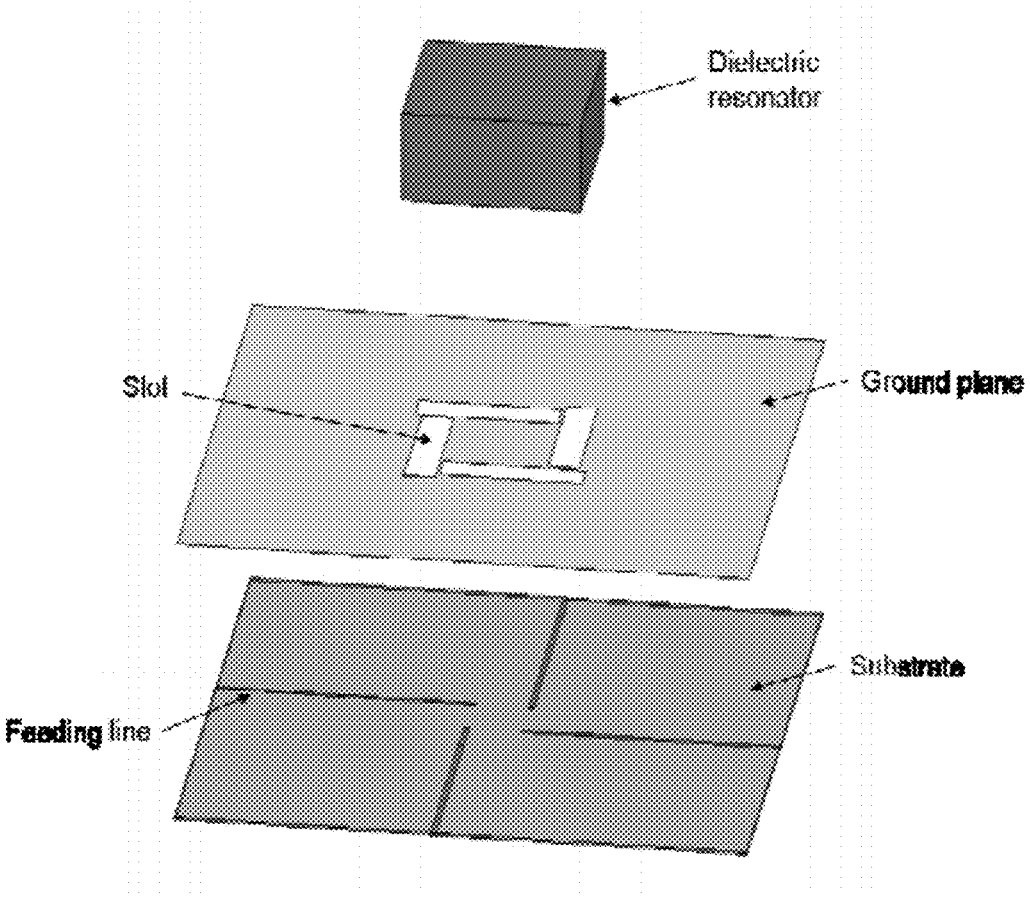
FIG. 3 shows an exploded view of a hybrid DRA in accordance with another embodiment of the present invention.

While the dielectric resonator 10 shown in FIG. 1 is cylindrical in shape, other shapes are contemplated by the present invention. For example, FIG. 3 is an exploded view of a hybrid DRA in accordance with another embodiment of the present invention, in which the dielectric resonator is rectangular in shape.

In one embodiment of the present invention, the dielectric resonator 10 was glued to the ground plane 20 for operatively coupling.

Figure 7:
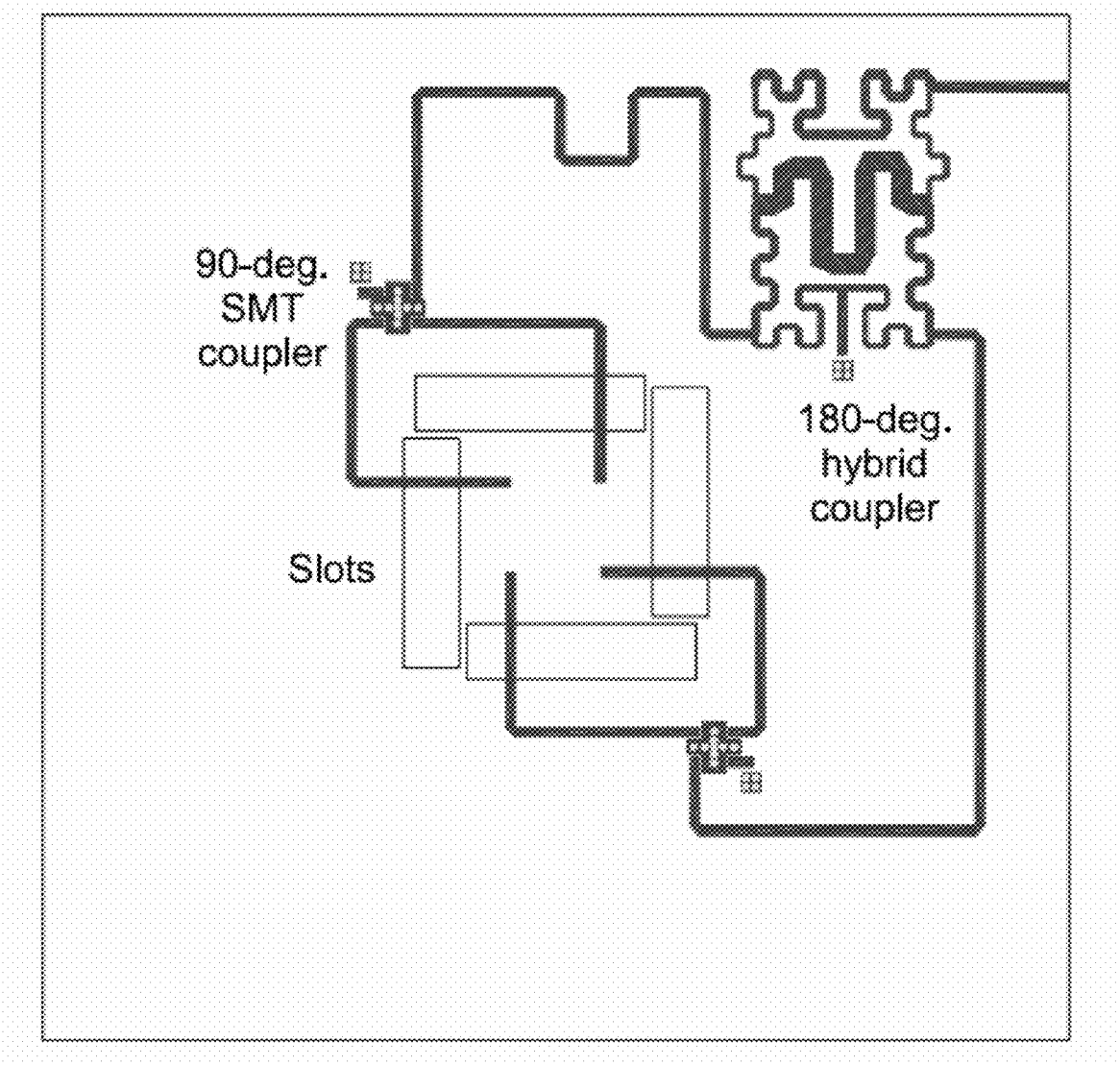
FIG. 7 shows a circuitry layout of the hybrid DRA feeding network in accordance with another embodiment of the present invention.
Figure 8A:
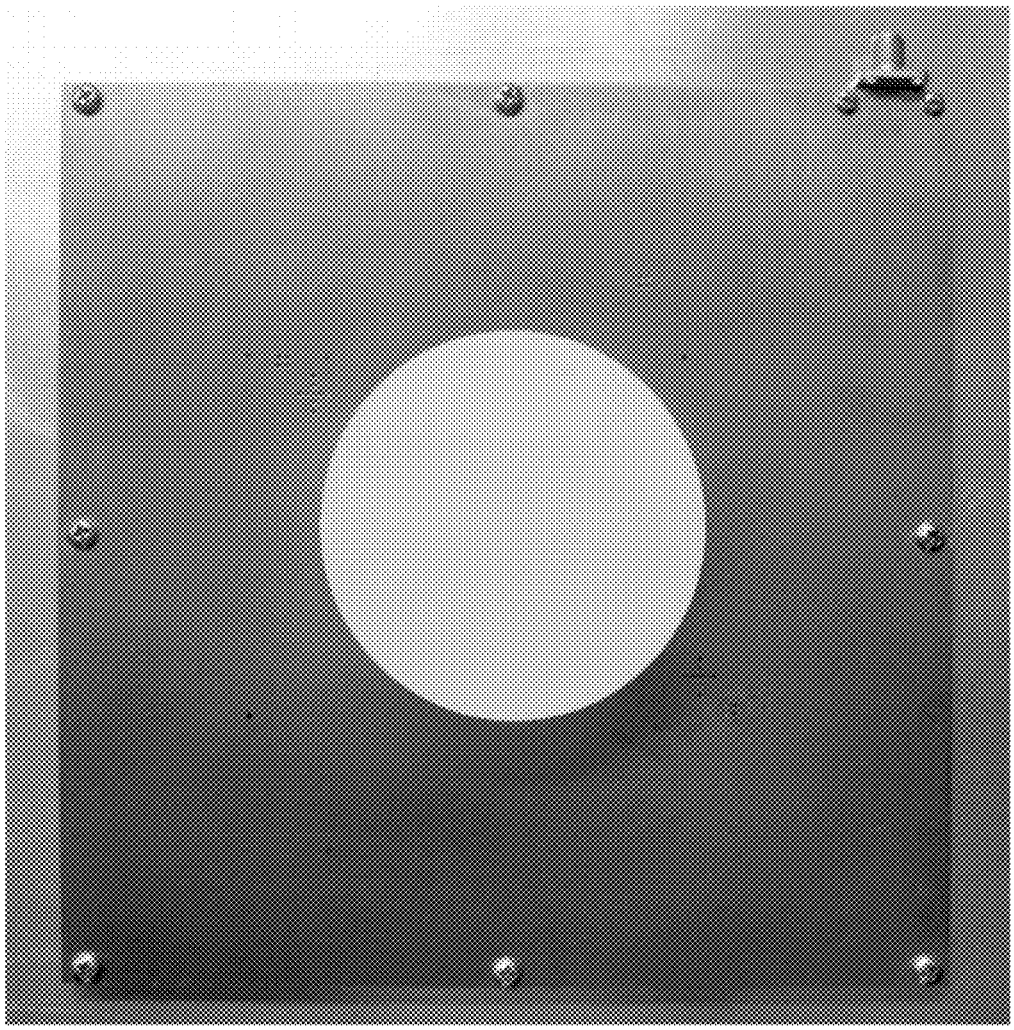
FIG. 8*a* shows a top view and FIG. 8*b* shows a bottom view of a hybrid DRA with the antenna feeding network fabricated in accordance with another embodiment of the present invention.
Figure 8B:
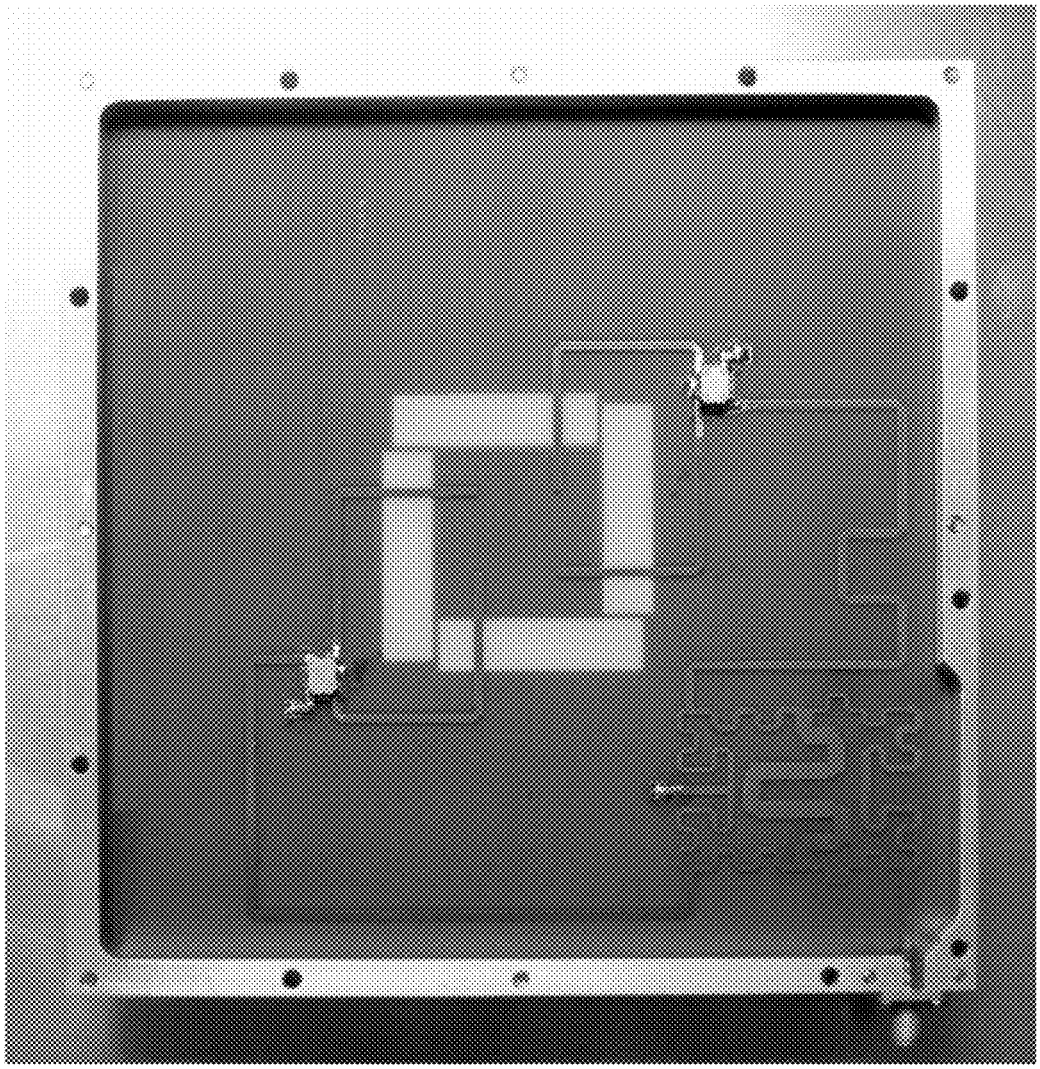

Also, according to another embodiment, plated thru holes were inserted into the substrate 40 to connect the ground plane 20 of the antenna to the ground plane of components of the feeding network for operative coupling (FIGS. 7 and 8A and 8B show the holes and the feeding network).

Figure 4:
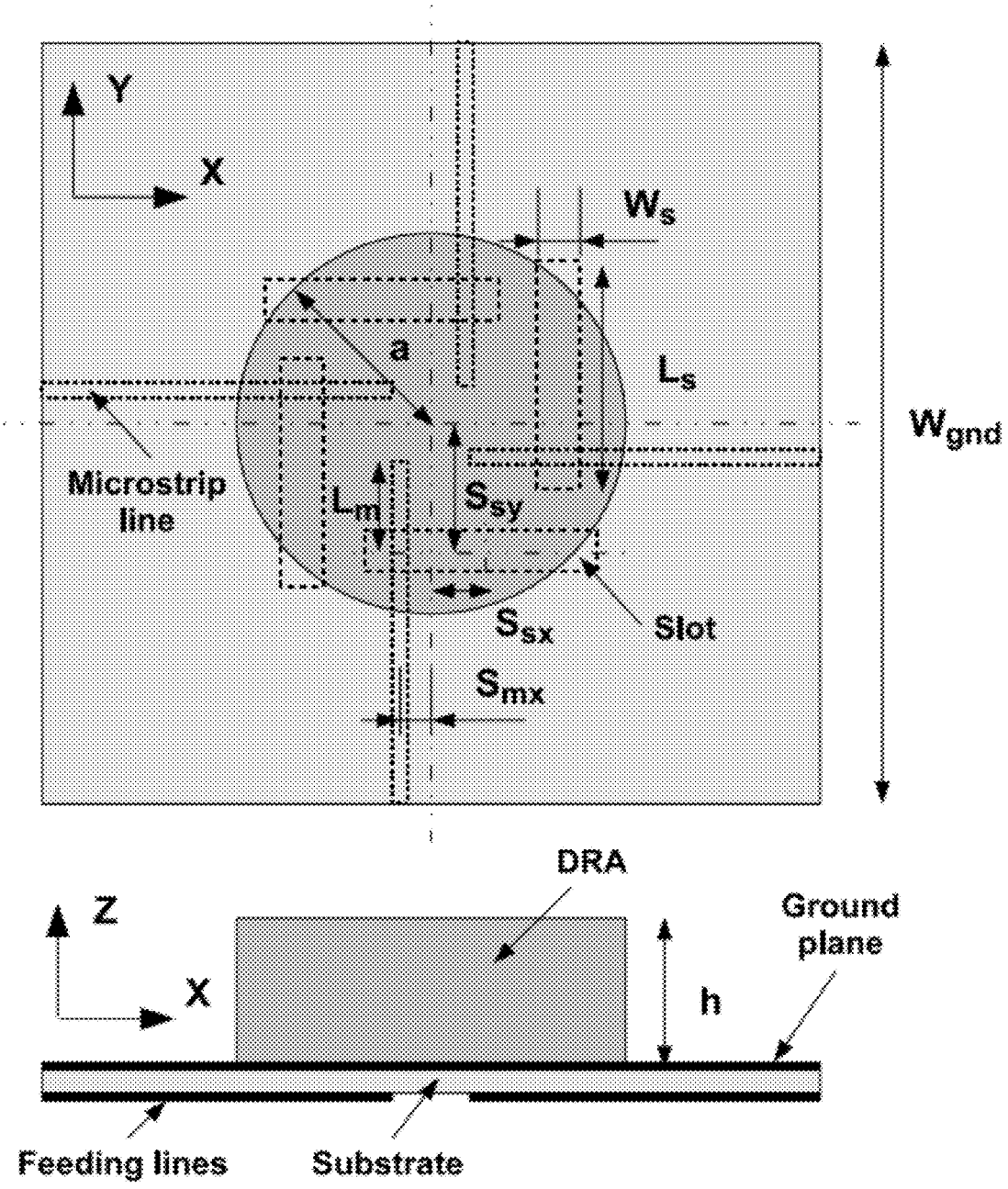
FIG. 4 shows a cross-sectional and side sectional view of the hybrid DRA in accordance with another embodiment of the present invention.

In accordance with another embodiment of the present invention, FIG. 4 shows a cross-sectional view in the upper portion of the drawing and a side sectional view of the hybrid DRA according to another embodiment of the present invention. Here, the slots shown are rectangular, rather than arc-shaped. In this embodiment, the hybrid DRA also has a dielectric resonator that is cylindrical, as shown in FIG. 1. For exemplary purposes, the cylindrical radius is a=31.75 mm and the cylindrical height is h=22 mm, wherein the dielectric resonators has permittivity equal to 10. The dielectric resonator shown in FIG. 4 has been designed to resonate at around 1.5 GHz.

According to the present invention and with further reference to FIG. 4, four degenerate HE11δ modes are excited using the four slots and are fed by the four microstrip feeding lines with a 90° phase difference to generate CP.

It should be mentioned here that the hybrid mode, referred to as HE if the electrical component is dominant or EH if the magnetic component is dominant, is commonly used to excite cylindrical DRAs. The HE11δ mode radiates like a short magnetic dipole, which is desirable for wide coverage. The mode subscripts refer to field variations in the azimuth, radial, and axial directions, respectively, in cylindrical coordinates.

In accordance with the present invention, the substrate 40 shown in FIGS. 1 through 4 and 13 may be made of FR-4 (the National Electrical Manufacturers Associations—NEMA) grade designation for glass reinforced epoxy laminate sheets) material ($\in r=4.4$) to accommodate the feeding circuit of the DRA. Alternatively and as a further example, the substrate may be made of CER-10 material, which is manufactured by Taconic™. The CER-10 substrate is an organic-ceramic laminate based on woven glass reinforcement. This material provides excellent dimensional stability and enhanced flexural strength.

As shown in FIG. 1, the slots 30A, 30B, 30C, 30D are etched in the ground plane. In the exemplary embodiment of FIG. 4, the Wgnd dimension of the ground plane is approximately 160 mm.

Also in the exemplary embodiment of FIG. 4, the length of the rectangular slots is close to $\lambda g/2$ at approximately 1.25 GHz, and thus the length dimension Ls is approximately 36 mm and the width Ws is approximately 8.8 mm. The feeding line stub length Lm is approximately 12.9 mm. The slots coordinates relative to the dielectric center are Ssx is approximately 4 mm along the x direction, and Ssy is approximately 19.4 mm in the y direction. The position of the feeding lines Smx relative to the vertical centerline of the substrate is approximately 11 mm.

In addition, the following hybrid dielectric resonator antennas have been designed using different dielectric permittivity, dielectric and slot shapes. Configurations [1], [2], and [5] have been fabricated and tested. The different configurations are summarized below in Table 1:

TABLE 1

Various hybrid DRA configurations

| Config. # | Dk | a [mm] | h [mm] | Dielectric shape | Slot shape | Substrate material |
|---|---|---|---|---|---|---|
| [1] | 10 | 50 | 24 | Square | Rectangular | FR-4 |
| [2] | 10 | 31.75 | 22 | Cylindrical | Rectangular | FR-4 |
| [3] | 10 | 31.75 | 22 | Cylindrical | Arc | FR-4 |
| [4] | 16 | 25.4 | 18 | Cylindrical | Arc | CER-10 |
| [5] | 30 | 19.05 | 15 | Cylindrical | Arc | CER-10 |

The last column in Table 1 specifies the type of substrate material used. In configurations [1] through [3], the substrate material used was FR-4, which has an approximate permittivity of 4.4. In configurations [4] and [5], the substrate material used was CER-10. The permittivity of this CER-10 material is 10 and is very stable over a range of frequencies.

The simulation and/or real testing of the various configurations demonstrated that both square and cylindrical shapes are suitable shapes for the dielectric resonator. It was found that both dielectric resonator shapes lead to similar performance. The arc-shaped slots also yielded very similar performance to the rectangular slots. A general consistency was observed between the simulations and the real measurements.

In configuration [5], the permittivity of this dielectric resonator was increased to significantly reduce its physical size. To determine the size of the resonator, equation [1] was used to calculate the required length of the slot, so as to ensure that the four slots could operatively fit underneath the dielectric resonator.

$$Ls=\lambda_0/(2*\mathrm{sqrt}(Dk)) \text{ where } \lambda_0=3e8/f \quad (1)$$

wherein: f=1.25 GHz and Dk is the dielectric permittivity

For example, the required length for the slots, where the dielectric resonator has a permittivity of 16, is Ls=30 mm. The available perimeter is the area delimited by the dielectric resonator perimeter and is estimated at 122 mm (based on an equation of 2*pi*(a−Ws/2−1 mm) with a=50.8 mm and Ws=10 mm), which is below 4*Ls. Based on these preceding calculations, further optimizations and adjustments may be required for adequate matching and coupling. The matching is tuned using a serial microstrip line stub of length Lm, starting at the center of the slot, and the coupling is adjusted using the slot location and width.

Figure 5:
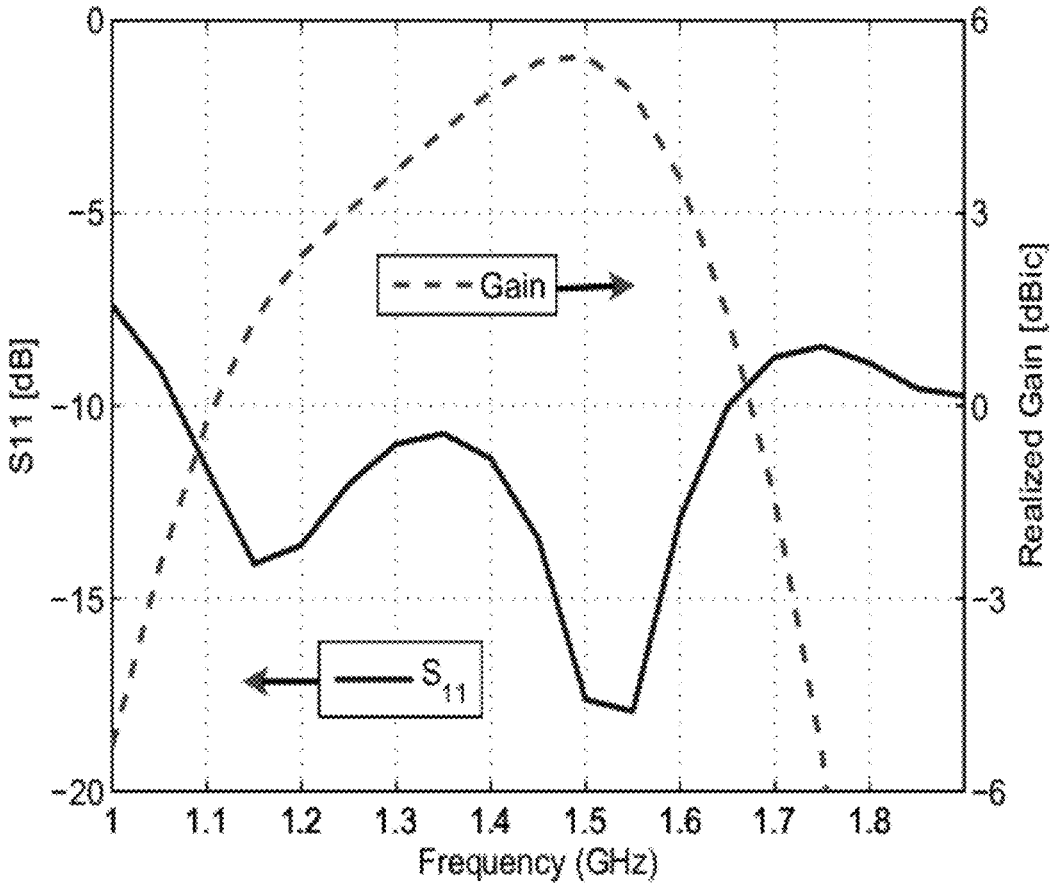
FIG. 5 shows a graphical representation of a simulated reflection coefficient and boresight gain of the hybrid DRA in accordance with another embodiment of the present invention.

For the hybrid DRA shown in FIG. 4, a graphical representation of a simulated reflection coefficient and boresight gain is shown in FIG. 5. The simulations using the commercial software HFSS ["High Frequency Structure Simulator v. 11.0," Ansoft Corp., 2008, online: www.ansoft.com.] show very good matching from 1.07 GHz to 1.65 GHz, corresponding to an impedance bandwidth of 44%. The gain at boresight is above 0 dBic from 1.11 to 1.68 GHz.

Figure 6:
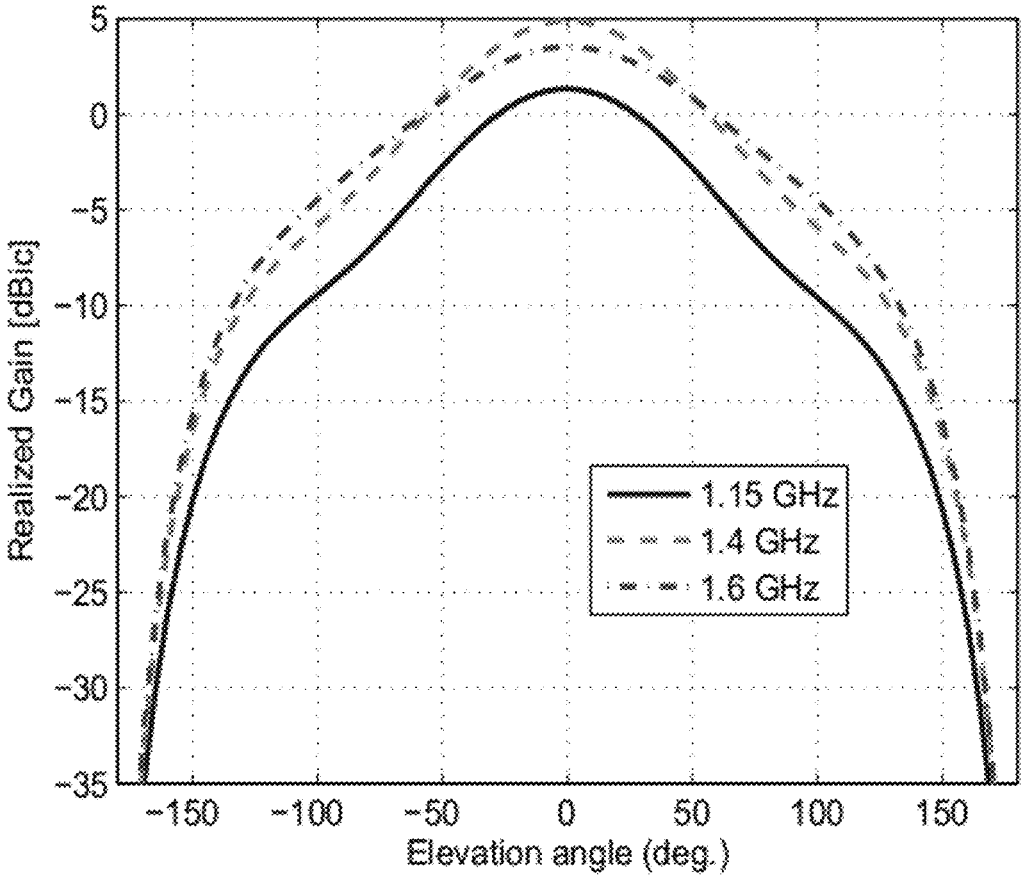
FIG. 6 shows a graphical representation of simulated coherent polarization radiation patterns of the hybrid DRA in accordance with another embodiment of the present invention.

For the hybrid DRA shown in FIG. 4, FIG. 6 shows a graphical representation of simulated coherent polarization radiation patterns of this hybrid DRA. The antenna feeding network was not part of the simulated model, and a 90° phase difference was applied between each of the four microstrip lines. The simulated half-power beamwidth (HPBW) is 90° at the lower and central frequencies, and increases to 110° towards the high end of the bandwidth. The obtained AR at boresight is under 0.1 dB over the entire band. The antenna presents an AR beamwidth (AR<3 dB) of 85 ° at 1.15 GHz, 100° at 1.4 GHz and 110° at 1.6 GHz.

It should be noted that the use of a rectangular dielectric resonator leads to a very similar configuration when exciting degenerate TEδ11 and TE1δ1 (Transverse Electric) modes. The transverse electric mode, referred to as TE, is commonly used to excite rectangular DRAs. The TEδ11 and TE1δ1 radiates like a short magnetic dipole. The subscripts represent the field variation in the X-, y-, and z-directions, respectively, in Cartesian coordinates. A square-shaped dielectric resonator is also contemplated. Therefore, the present invention is not limited to the shape of the dielectric resonator. However, the cylindrical shape may be more suitable in commercial applications because it has a more compact surface area.

FIG. 7 shows a circuitry layout of the hybrid DRA feeding network in accordance with another embodiment of the present invention. The antenna feeding network has to provide 90° phase difference between the four slots over a wideband. To achieve this, a compact wideband rat-race as detailed in the prior art [M. Caillet, M. Clénet, A. Sharaiha, and Y. M. M. Antar, "A Compact Wide-Band Rat-Race Hybrid Using Microstrip Lines," IEEE Microw. Wireless Compon. Lett., vol. 19, no. 4, pp. 191-193, April 2009] has been combined with two surface mount (SMT) branch-line hybrid couplers [3-dB/90° hybrid coupler, "Model XC1400P-03S" Anaren®, online: www.anaren.com].

The antenna shown in FIG. 4 was fabricated using Emerson & Cuming Eccostock HIK10 dielectric of an approximate permittivity of 10 for the dielectric resonator, and an FR4 substrate of approximately 30 mil (0.76 mm) thickness for the feeding network.

FIG. 8*a* shows a top view and FIG. 8*b* shows a bottom view of a hybrid DRA fabricated in accordance with another embodiment of the present invention. Plated thru holes were inserted into the substrate to operatively connect the ground plane of the antenna to the ground of the SMT branch-line hybrid couplers of the feeding network shown in FIG. 7.

Figure 9:
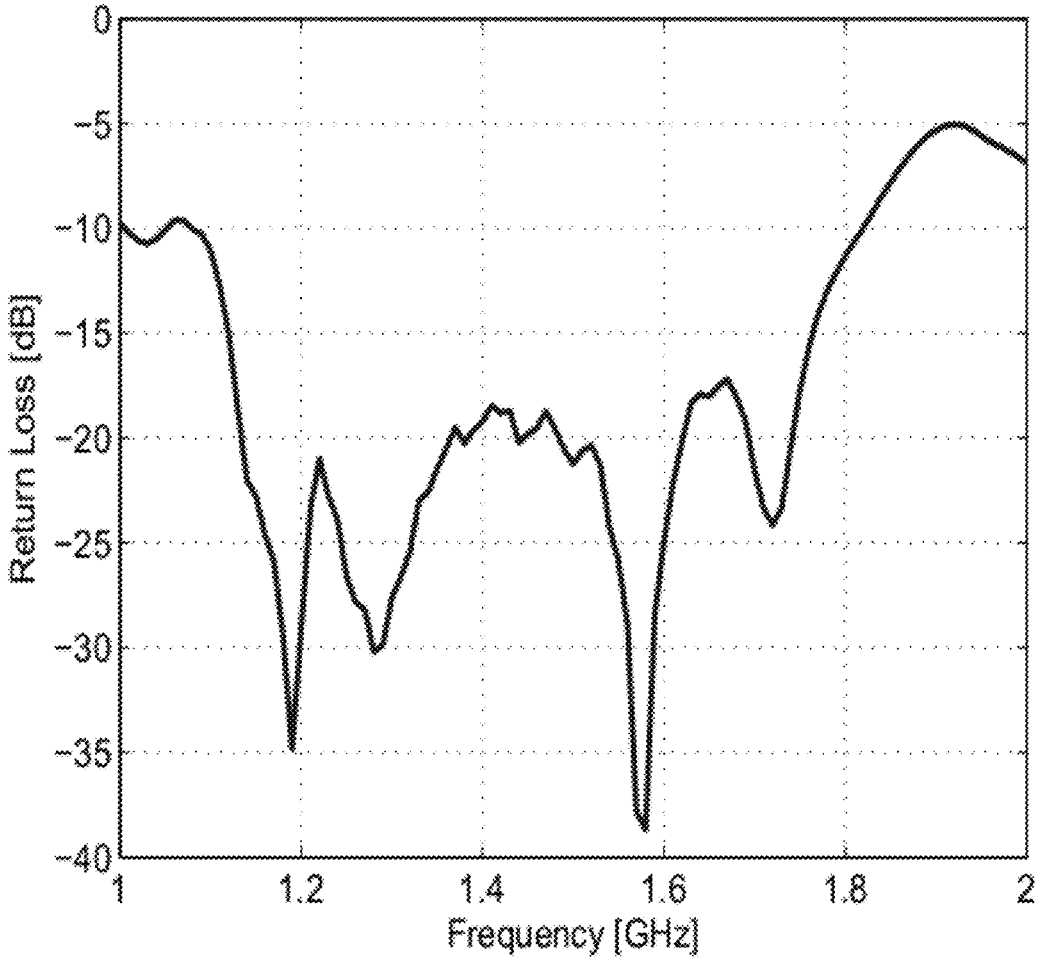
FIG. 9 shows a graphical representation of an experimental reflection coefficient of the hybrid DRA in accordance with another embodiment of the present invention.

FIG. 9 shows a graphical representation of an experimental reflection coefficient of the hybrid DRA shown in FIG. 4. It can be seen that the DRA covers the 1.08 to 1.82 GHz frequency band, corresponding to an impedance bandwidth of 51%.

Figure 10:
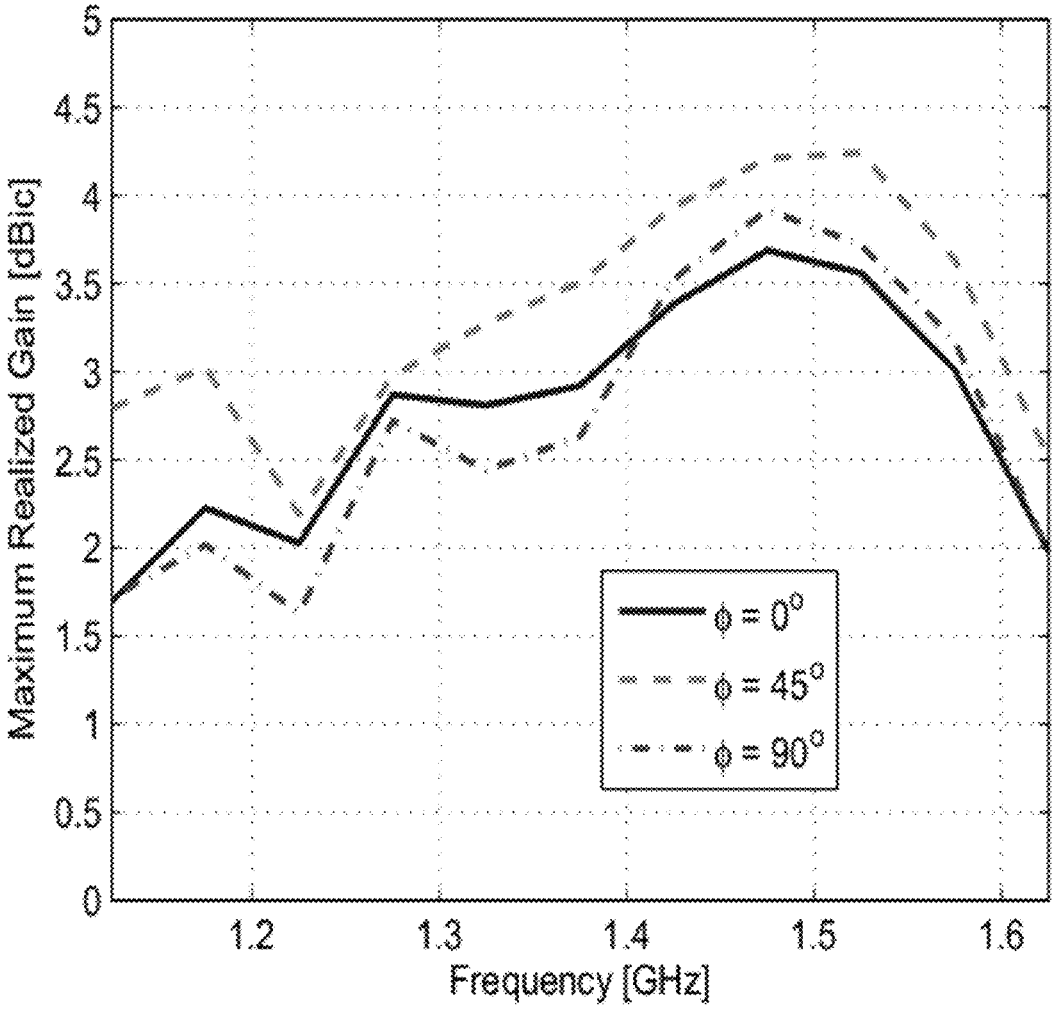
FIG. 10 shows a graphical representation of experimental maximum realized gain as a function of the frequency in accordance with another embodiment of the present invention.

Concerning the radiation characteristics, they were measured from 1.125 to 1.625 GHz in an anechoic chamber. FIG. 10 shows a graphical representation of experimental maximum realized gain as a function of the frequency of the hybrid DRA shown in FIG. 4. The experimental maximum realized gain remains above 1.5 dBic over the entire band, with a peak around 3.75 dBic at 1.475 GHz.

Figure 11:
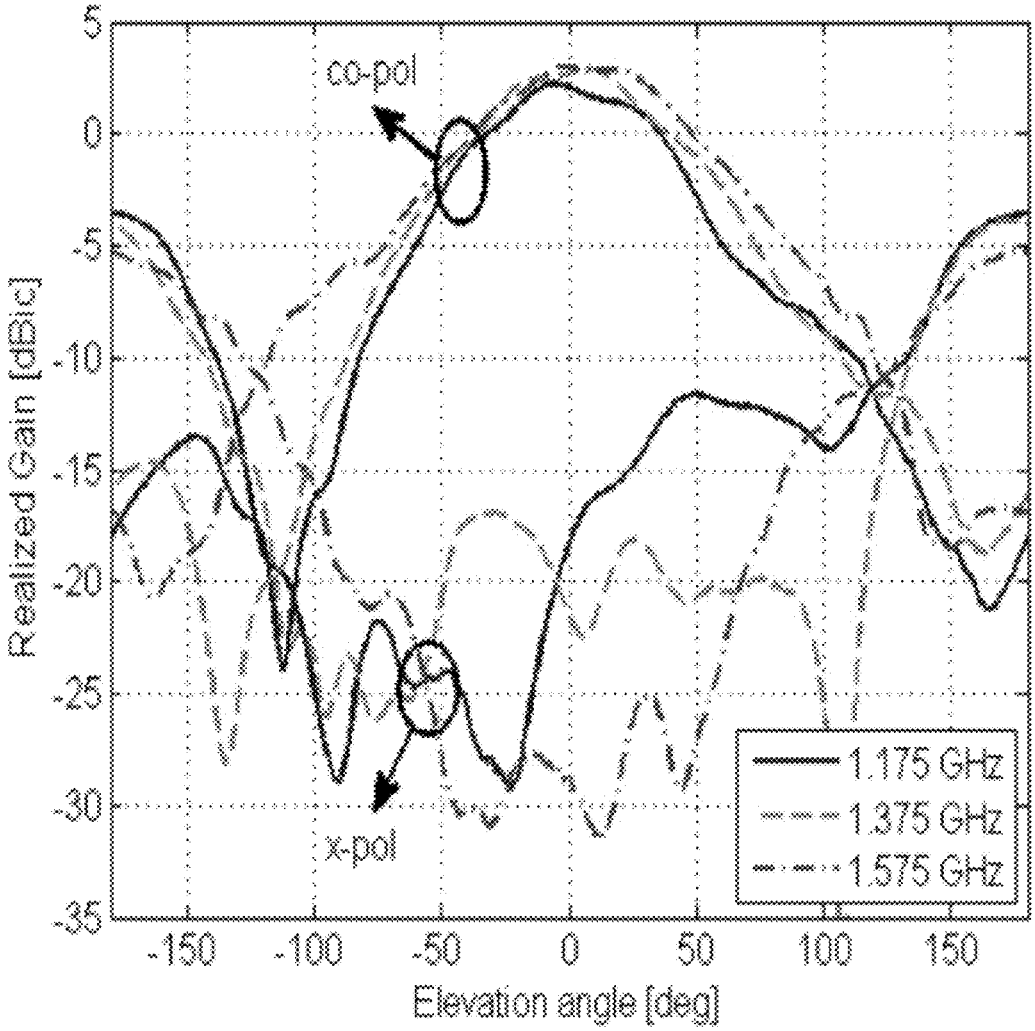
FIG. 11 shows a graphical representation of experimental radiation patterns as a function of the elevation angle for the cut $\phi=0°$ in accordance with another embodiment of the present invention.

FIG. 11 shows a graphical representation of an experimental radiation patterns as a function of the elevation angle for the cut $\phi=0°$ of the hybrid DRA shown in FIG. 4. The measured HPBW is 75° at 1.175 GHz, 80° at 1.375 GHz and 85° at 1.575 GHz.

Figure 12:
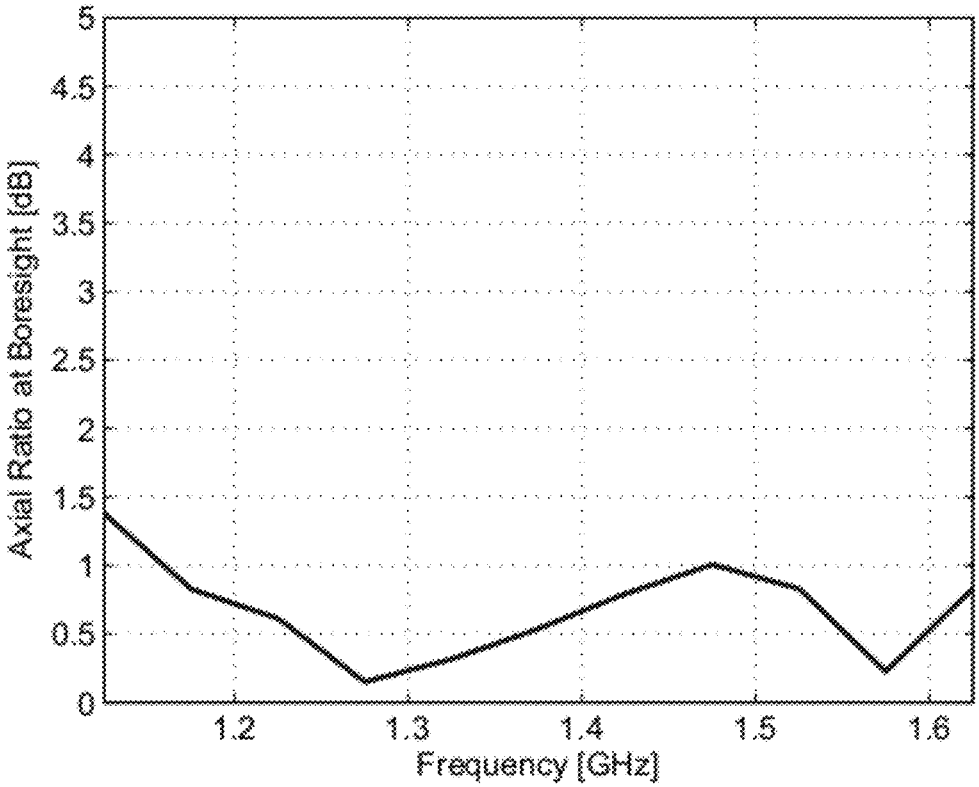
FIG. 12 shows a graphical representation of an experimental axial ratio at boresight as a function of the frequency in accordance with another embodiment of the present invention.

FIG. 12 shows a graphical representation of an experimental axial ratio at boresight as a function of the frequency for the hybrid DRA shown in FIG. 4. The AR at boresight remains under 1.5 dB over the entire band. The AR beamwidth is 140° at 1.175 GHz, 200° at 1.375 GHz and 195° at 1.575 GHz for the planes $\phi=0°$ and $\phi=90°$. Regarding the cut at $\phi=45°$, a narrower AR beamwidth of 100° has been noticed at all investigated frequencies.

The antenna efficiency of the hybrid DRA shown in FIG. 4 was evaluated by comparing the directivity and the measured gain, and found to be over 70%. The overall performance of the fabricated antenna is very similar to the simulated results.

Due to the presence of the slots, back-radiation does occur. The front to back radiation ratio varies from 5 dB at 1.15 GHz to 10 dB at 1.6 GHz. In accordance with an embodiment of the present invention, the back-radiation level can be reduced using a metallic back plate housing appropriately positioned at the back of the antenna. For instance, a front to back radiation ratio of 10 dB was achieved at 1.15 GHz using an approximately 150×150 $mm^2$ metallic sheet located 15 mm behind the slots. No significant effect has been observed regarding the antenna characteristics (impedance, gain, radiation patterns and AR).

It should be clearly understood by the skilled artisan that the back plate housing is an optional element of the present invention.

Figure 13:
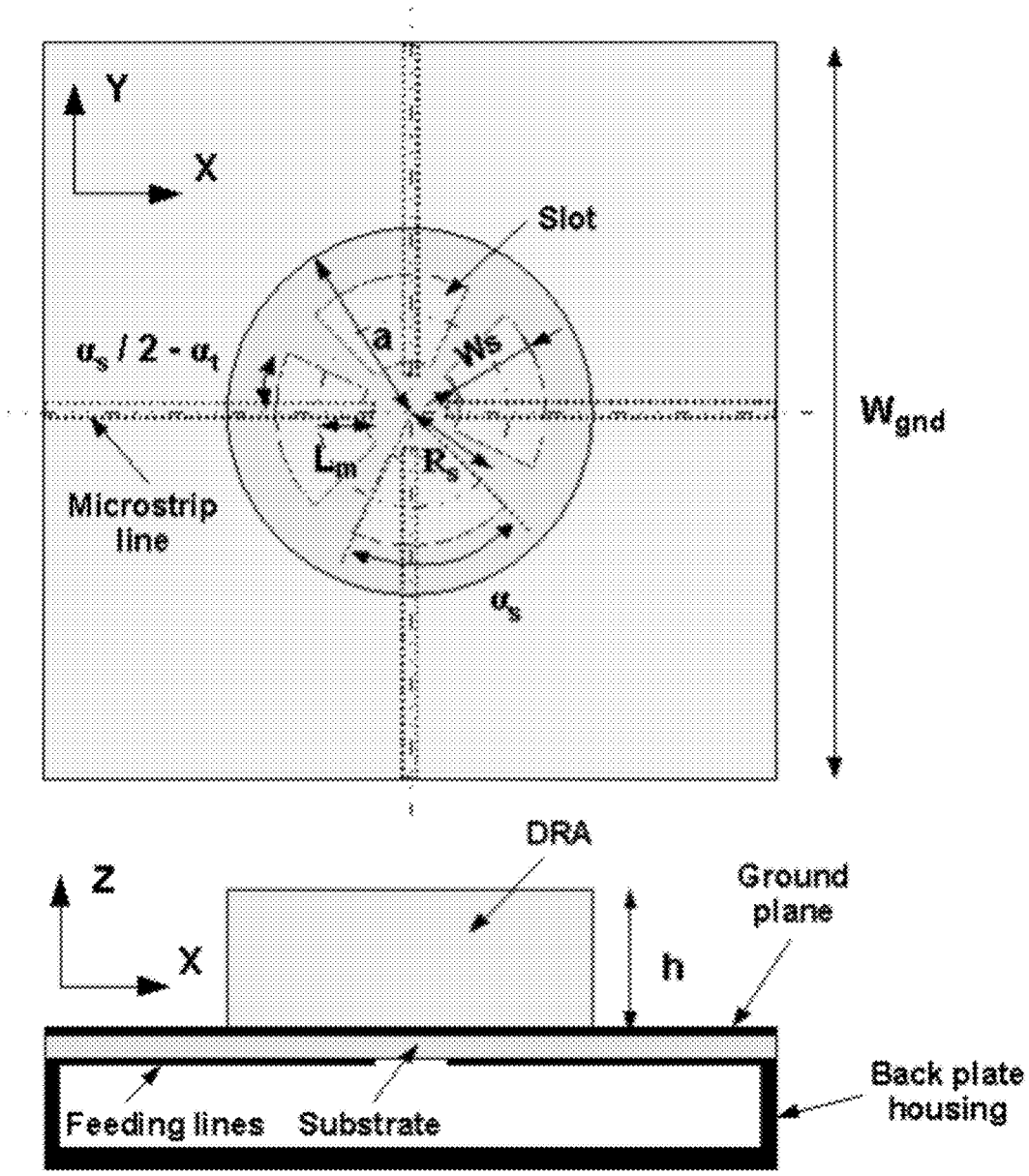
FIG. 13 shows cross-sectional and side views of the hybrid DRA showing arc-shaped slots in accordance with another embodiment of the present invention.

To make the antenna more compact in size, the present invention contemplates reducing the surface area it occupies. Permittivities of approximately 16 and 30 have been successfully used for the dielectric resonator. Also, as previously mentioned with reference to FIG. 3, the shape of the slots may be modified to an arc, and this provides more efficient coupling than using rectangular-shaped slots as the slots are completely confined within the circle corresponding to the DRA circumference. The resultant geometry is shown in FIG. 13. The surface of the compact dielectric resonator design using a permittivity of 30 is approximately 28% the surface of the cylindrical-shaped design having a permittivity of 10. In FIG. 13, each of the four arc slots has a radius of approximately 19 mm, an approximate angle αs of 89°, and Ws is approximately 12 mm wide. Also, the height h of this dielectric resonator is approximately 15 mm. The angle αt is approximately 10° and the length Lm is approximately 8 mm. The width of the ground plane Wgnd is approximately 100 mm.

Figure 14:
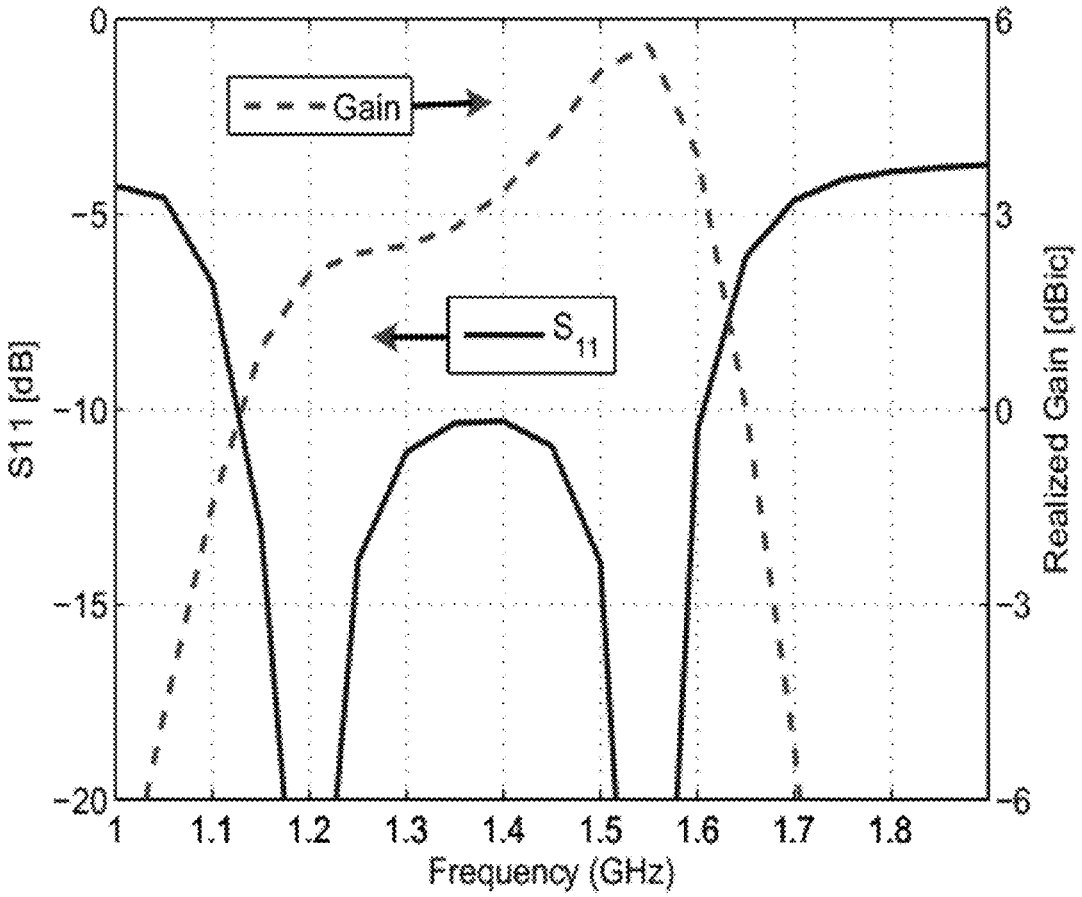
FIG. 14 shows a graphical representation of a simulated reflection coefficient and boresight gain of the hybrid DRA shown in FIG. 13.

FIG. 14 shows a graphical representation of a simulated reflection coefficient and boresight gain of the hybrid DRA shown in FIG. 13. The simulated reflection coefficient and gain bandwidth are slightly reduced compared to the DRA using a dielectric resonator having a permittivity of approximately 16, but it still provides enough bandwidth to cover all the SNS applications. Radiation patterns and axial ratio are almost identical to the rectangular-shaped geometry.

It should also be mentioned that the present invention includes a conventional unilayer substrate material, where basic shapes such as square or cylinder can be used for the DRA, and no drilling into the dielectric resonator is required.

By using a higher permittivity dielectric, the DRA surface width and height may be significantly reduced over the prior art designs. Yet, performance of the hybrid DRA is very similar to the original antenna. This new wideband CP hybrid DRA has shown close performance compared to other SNS antennas of the prior art.

The compact geometry of the hybrid DRA of the present invention, whose smallest simulated radius is approximately 19 mm and whose smallest corresponding height is approximately 15 mm, is among the smallest SNS antennas present in the literature. For example, the stack patch antenna of the prior art is 61 mm wide, the cross printed dipole of the prior art is 70 mm wide and 50 mm height, or the FPQHA (folded planar quadrifilar helical antenna) of the prior art has a radius of 36 mm, and a height of 130 mm. In accordance with the present invention, hybrid DRAs of smaller size can be fabricated with higher dielectric constant material.

The embodiments of the invention described above are intended to be only exemplary, and not a complete description of every aspect the invention. The scope of the invention is therefore intended to be limited solely by the scope of the appended claims.

What is claimed is:

1. A dielectric resonator antenna comprising:

a dielectric resonator;

a ground plane, operatively coupled with the dielectric resonator, the ground plane having four independent slots with each slot being arc in shape and forming a ring configuration; and a substrate, operatively coupled to the ground plane, having a feeding network consisting of four microstrip lines, with each microstrip line feeding independently into each slot;

wherein the four slots are constructed and geometrically arranged to ensure circular polarization and coupling to the dielectric resonator;

wherein the antenna feeding network combines the four microstrip lines with a 90 degree phase difference to generate circular polarization over a wide frequency band; and wherein the feeding network includes a compact wideband rat-race combined with two surface mount (SMT) branch-line hybrid couplers.

2. The dielectric resonator antenna as in claim 1, further including a back plate housing operatively coupled to the substrate.

3. The dielectric resonator antenna as in claim 1, wherein the dielectric resonator is cylindrical in shape.

4. The dielectric resonator antenna as in claim 1, wherein the dielectric resonator is dimensioned to excite a hybrid HE11δ mode.

5. The dielectric resonator antenna as in claim 1, wherein the dielectric resonator is cylindrical in shape with a cylindrical radius of 25.4 mm, a cylindrical height of 18 mm and a dielectric permittivity of 16 and wherein the substrate is made of CER-10 material.

6. The dielectric resonator antenna as in claim 1, wherein the dielectric resonator is cylindrical in shape with a cylindrical radius of 19.05 mm, a cylindrical height of 15 mm and a dielectric permittivity of 30 and wherein the substrate is made of CER-10 material.

7. The dielectric resonator antenna as in claim 1, wherein the dielectric resonator is square in shape.

8. The dielectric resonator antenna as in claim 1, wherein the dielectric resonator is glued to the ground plane.

9. The dielectric resonator antenna as in claim 1, further includes plated thru holes that provide a common ground plane between the dielectric resonator and the feeding network.

10. The dielectric resonator antenna as in claim 1, wherein the dielectric resonator has a dielectric permittivity of a range of approximately 10 to approximately 30.

11. The dielectric resonator antenna as in claim 1, further including a metallic back plate housing operatively coupled to the substrate.

12. The dielectric resonator antenna as in claim 1, wherein the substrate is made of FR-4 material.

13. The dielectric resonator antenna as in claim 1, wherein the substrate is made of CER-10 material.

14. The dielectric resonator antenna as in claim 3, wherein the four slots excite four degenerate HE11δ resonance modes.

15. The dielectric resonator antenna as in claim 7, wherein the four slots excite two degenerate TEδ11 and TE1δ1 modes.

* * * * *